US006501497B2

(12) United States Patent
Shirakawa et al.

(10) Patent No.: US 6,501,497 B2
(45) Date of Patent: Dec. 31, 2002

(54) THERMAL HEAD WITH SMALL SIZE OF STEPS OF PROTECTIVE LAYER FORMED ON HEATING PORTION AND MANUFACTURING METHOD THEREOF

(75) Inventors: Takashi Shirakawa, Iwate-ken (JP); Masayoshi Takeuchi, Iwate-ken (JP); Satoshi Kubo, Iwate-ken (JP); Daiki Sugiyama, Iwate-ken (JP); Noboru Tsushima, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/940,777

(22) Filed: Aug. 27, 2001

(65) Prior Publication Data

US 2002/0024582 A1 Feb. 28, 2002

(30) Foreign Application Priority Data

Aug. 31, 2000 (JP) ..... 2000-268402

(51) Int. Cl.[7] ..... B41J 2/335; B41J 2/345
(52) U.S. Cl. ..... 347/208
(58) Field of Search ..... 347/200, 208; 29/611

(56) References Cited

U.S. PATENT DOCUMENTS 4,907,015 A * 3/1990 Kaneko et al. ..... 347/208
5,272,489 A * 12/1993 Kobayashi et al. ..... 347/208
5,594,488 A 1/1997 Tsushima et al.

FOREIGN PATENT DOCUMENTS

JP 60-21264 * 2/1985 ..... 347/208
JP 01-204763 * 8/1989 ..... 347/208

* cited by examiner

*Primary Examiner*—Huan Tran
(74) *Attorney, Agent, or Firm*—Brinks Hofer Gilson & Lione

(57) ABSTRACT

The present invention provides a thermal head having a long lifetime and a high printing quality by making the size of steps of a protective layer formed on a heating portion of a heating resistor small and a method for manufacturing the thermal heads. In the thermal head, respective lower-layer electrodes having a film thickness of approximately 2 $\mu$m are formed on outskirts portion of a bulging portion of a heat insulation layer excluding a heating portion of a heating resistor and portions in the vicinity of the heating portion. Then, respective upper-layer electrodes having a film thickness which falls in a range of 0.1 to 0.3 $\mu$m are continuously formed from portions at positions in the vicinity of the heating portion excluding the heating portion to upper surfaces of the lower-layer electrodes. Due to such a constitution, the size of the steps formed in the protective layer can be made extremely small and hence, it becomes possible to prevent dregs and dusts which are generated during printing from being gathered at the steps.

5 Claims, 2 Drawing Sheets

THERMAL HEAD WITH SMALL SIZE OF STEPS OF PROTECTIVE LAYER FORMED ON HEATING PORTION AND MANUFACTURING METHOD THEREOF

BACKGROUND OF THE INVENTION

1. Field of the Invention

The present invention relates to a thermal head for us with a thermal printer, and more particularly, to a thermal head having an improved printing quality and printing lifetime, and a manufacturing method thereof.

2. Description of the Prior Art

In a conventional thermal head, in general, a glaze heat insulation layer is formed on an upper surface of an alumina substrate, and a plurality of heating resistors are arranged in series on an upper surface of the glaze heat insulation layer. Heating portions formed on respective heating resistors are selectively made to generate heat so as to perform a thermal transfer of ink on a thermal transfer ribbon to plain paper, thus enabling the printing of given letters or given images to the plain paper or to directly perform the printing to thermosensitive paper.

To explain such a conventional thermal head in conjunction with FIG. 3, a glaze layer 2 having a bulging portion 2*a* is formed at a position close to an end of a heat radiation substrate 1 made of aluminum or the like.

To an upper surface of the glaze layer 2, a film made of Ta-SiO2 or the like, is laminated by sputtering or the like and the film made of Ta-SiO2 or the like is subjected to patterning by photolithography to form a heating resistor 3.

An electrode 4 for supplying electric energy to the heating resistor 3 which has a thickness of approximately 2 $\mu$m is laminated to an upper surface of the heating resistor 3 by sputtering any one of aluminum, copper, gold and the like or by other techniques. Then, the electrode 4 is subjected to patterning to form a common electrode 4*a* and an individual electrode 4*b* by means of a photolithography technique.

Then, at a portion on the heating resistor 3 which is sandwiched by respective ends of the common electrode 4*a* and the individual electrode 4*b,* a heating portion 3*a* is formed at a given interval.

Further, on respective upper surfaces of the common electrode 4*a*, the individual electrode 4*b* and the heating resistor 3, a protective layer 5 made of hard ceramic is formed so as to prevent oxidization or wear of the heating resistor 3 or respective electrodes 4*a*, 4*b* thus enhancing the durability or the lifetime of the thermal head at the time of printing.

Then, by selectively supplying electric power to the electrode 4 in response to printing information, the heating portion 3*a* selectively generates heat such that the thermosensitive paper is colored or ink of an ink ribbon is transferred to plain paper or the like so as to print-given letters or images.

However, the respective electrodes 4*a*, 4*b* of the abovementioned conventional thermal head are formed such that the bodies 4*a*, 4*b* have a large film thickness of approximately 2 $\mu$m so as to reduce the conductive resistance which is generated at the time of feeding power whereby the lowering of the printing quality and the printing thermal efficiency can be obviated.

Accordingly, the respective electrodes 4*a*, 4*b* and the heating portion 3*a* are formed in a stepped shape such that steps 5*a* are formed on the protective layer 5 on the respective electrodes 4*a*, 4*b* and the heating portion 3*a*. Here, dregs and fine dusts which are generated at the time of printing are gathered at the steps 5*a* so that there arises a problem that the printing quality and the thermal efficiency are lowered.

Further, the respective electrodes 4*a*, 4*b,* in general, are often made of a soft material such as aluminum which is inexpensive, exhibits excellent workability and favorable conductivity. However, a contact pressure force which brings the heating portion 3*a* of the thermal head into contact with a platen (not shown in the drawing) is repeatedly applied to the heating portion 3*a* at the time of printing. Accordingly, with respect to the electrode 4 which is formed of the soft material such as aluminum, ends of the electrodes 4*a,* 4*b* which are close to the heating portion 3*a* are deformed and there is a possibility that it gives rise to the cracks or the peeling-off in the protective layer 5.

When the cracks or the peeling-off are generated in the protective layer 5, it brings about the change of the resistance value of the heating resistor 3 and hence, there arises a problem that the printing quality and the printing lifetime of the thermal head are lowered.

SUMMARY OF THE INVENTION

The present invention has been made in view of the above mentioned problems, and it is an object of the present invention to provide a thermal head having a long lifetime and a high printing quality by decreasing the size of steps of a protective layer formed on a heating portion. It is also an object of the present invention to provide a manufacturing method thereof.

According to a first aspect of the present invention, a thermal head of the present invention which is provided for solving the abovementioned drawbacks includes a heat insulation layer which is formed on a substrate, a plurality of heating resistors which are formed on an upper surface of the heat insulation layer, a plurality of electrodes which are connected to the heating resistors and form heating portions at portions of the heating resistors, and a protective layer which covers surfaces of the heating resistors and the electrodes, wherein the electrodes are made of lower-layer electrodes and upper-layer power feeding layers, wherein the lower-layer electrodes and the upper-layer power feeding layers are dissolved by one etchant, wherein the lower-layer electrodes are formed at positions excluding the heating portions and positions in the vicinity of the heating portions, and wherein the upper-layer electrodes are continuously formed from portions at positions in the vicinity of the heat generating bodies to upper surfaces of the lower-layer electrodes excluding the heating portions.

According to a second aspect of the present invention, a thermal head of the present invention which is provided for solving the abovementioned drawbacks is constituted such that a material which constitutes at least the lower-layer electrodes or the upper-layer electrodes is made of any material selected from a group consisting of aluminum, copper, gold and an alloy of these metals.

According to a third aspect of the present invention, a thermal head of the present invention which is provided for solving the abovementioned drawbacks is constituted such that a film thickness of the upper-layer electrodes is set to a value which falls within a range of 0.1 to 0.3 $\mu$m.

According to a fourth aspect of the present invention, a thermal head manufacturing method of the present invention which is provided for solving the abovementioned drawbacks includes a first step in which a heat insulation layer is formed on a substrate, a second step in which a plurality of heating resistors are formed on an upper surface of the heat insulation layer, a third step in which electrodes which are connected to heat resistors are formed, and a fourth step in which a protective layer which covers at least surfaces of the heating resistors and the electrodes is formed, wherein the third step is comprised of a step in which metal films are formed on the heating resistors by patterning so as to form lower-layer electrodes on portions excluding heating portions and portions at positions in the vicinity of the heating portions of the heating resistor and a step in which metal films are continuously formed by patterning from portions at positions in the vicinity of the heating portions to upper surfaces of the lower-layer electrodes excluding the heating portions so as to form upper-layer electrodes from portions at positions in the vicinity of the heating portions to upper surfaces of the lower-layer electrodes excluding the heating portion.

According to a fifth aspect of the present invention, in a thermal head manufacturing method of the present invention which is provided for solving the abovementioned drawbacks, the lower-layer electrodes and the upper-layer electrodes are made of one material.

According to a sixth aspect of the present invention, in a thermal head manufacturing method of the present invention which is provided for solving the abovementioned drawbacks, a material which constitutes at least the lower-layer electrodes or the upper-layer electrodes is any material selected from a group consisting of aluminum, copper, gold and an alloy of these metals.

According to a seventh aspect of the present invention, in a thermal head manufacturing method of the present invention which is provided for solving the abovementioned drawbacks, a film thickness of the upper-layer electrodes is set to a value which falls within a range of 0.1 to 0.3 $\mu$m.

According to an eighth aspect of the present invention, in a thermal head manufacturing method of the present invention which is provided for solving the abovementioned drawbacks, the metal films which constitute the upper-layer electrodes are formed into films by a sputtering technique.

DESCRIPTION OF THE PREFERRED EMBODIMENTS

Figure 1:
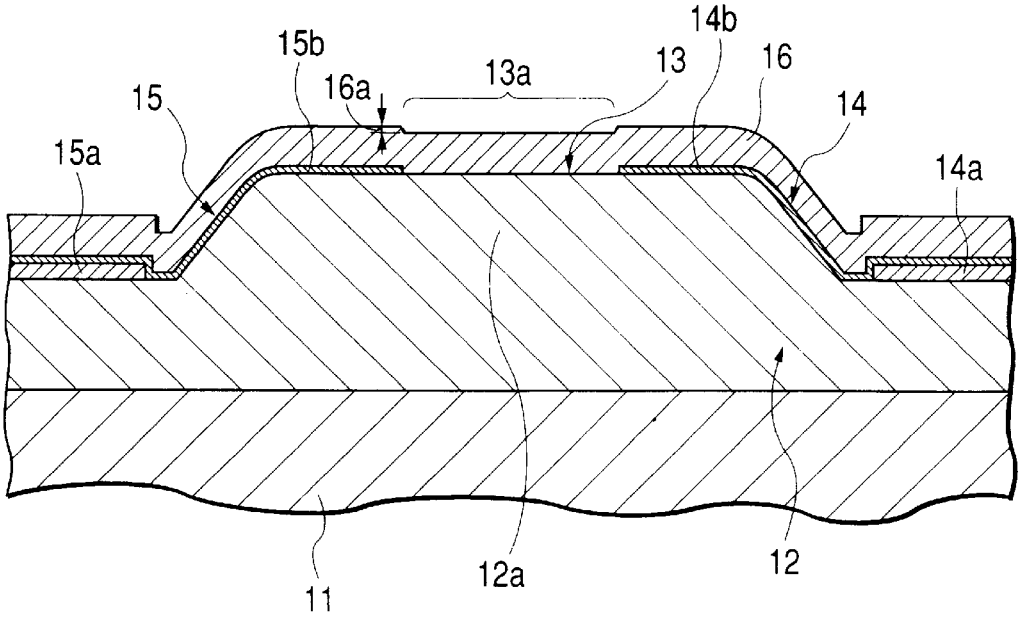
FIG. 1 is a cross-sectional view of an essential portion of a thermal head according to the present invention.

Embodiments of a thermal head and a method for manufacturing thermal heads are explained in conjunction with attached drawings hereinafter. In the drawings, FIG. 1 is a cross-sectional view of an essential portion of a thermal head of the present invention and FIG. 2 is a flow chart showing the method for manufacturing thermal heads of the present invention.

Figure 2:
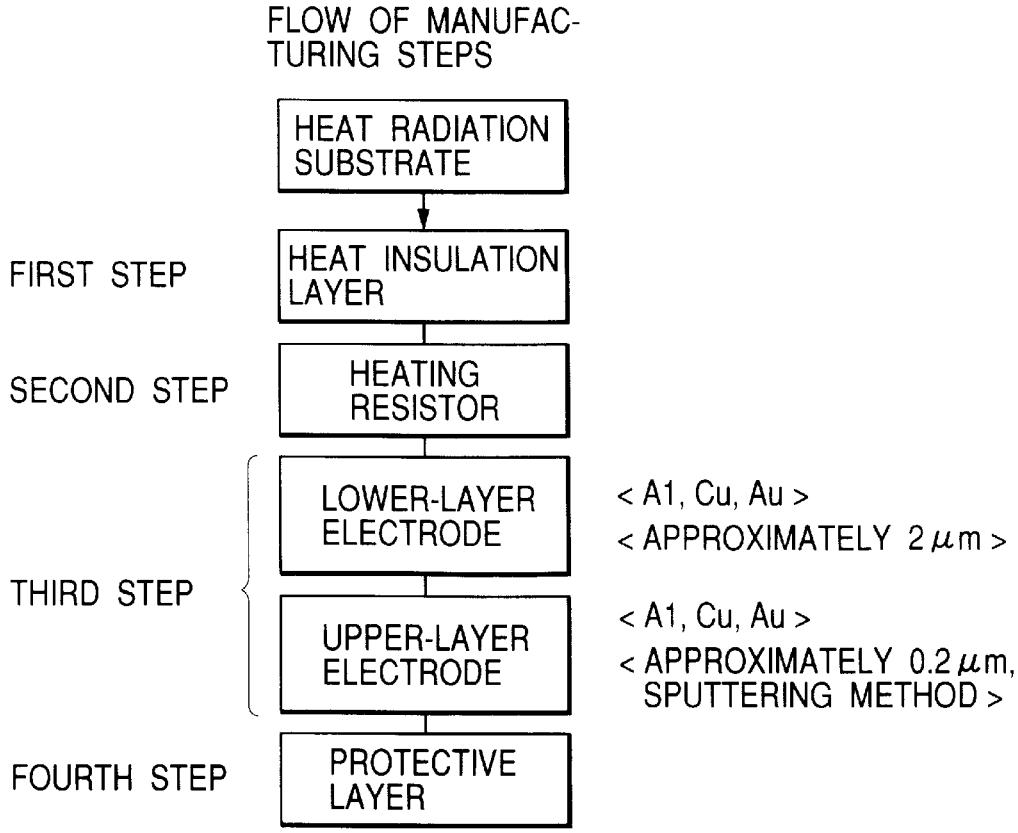
FIG. 2 is a flow chart of a thermal head manufacturing method according to the present invention.
Figure 3:
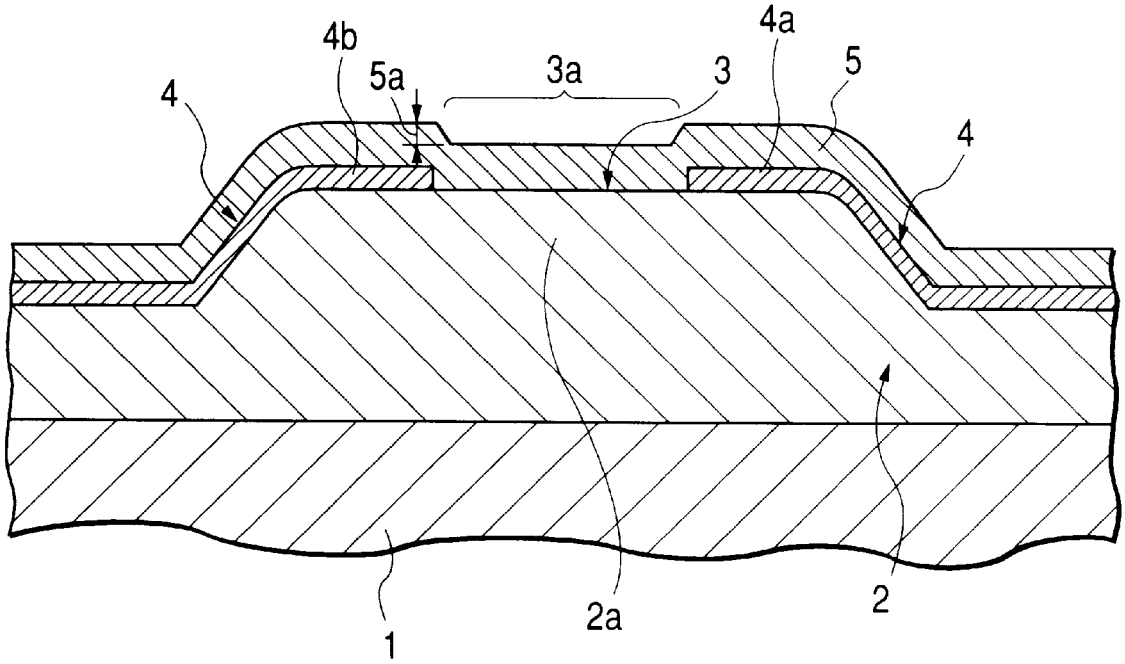
FIG. 3 PRIOR ART
FIG. 3 is a cross-sectional view of an essential portion of a conventional thermal head.

First of all, in a thermal head according to a first embodiment of the present invention, as,shown in FIG. 1, on an upper surface of a substrate 11 made of aluminum or the like which has a favorable heat radiation ability, a heat insulation layer 12 which is made of a glass glaze having a thickness of an approximately 30 to 80 $\mu$m is formed.

On a surface of the heat insulation layer 12, a bulging portion 12*a* having a height size of approximately 3 to 15 $\mu$m is formed by photolithography technique. On an upper surface of the heat insulation layer 12, a heating resistor 13 which is made of Ta-SiO2 or the like is laminated by sputtering or the like and this heating resistor 13 is subjected to patterning by photolithography technique.

On an upper surface of the heating resistor 13, for supplying electric energy to the heating resistor 13, a common electrode 14 and an individual electrode 15 are formed such that they face each other while sandwiching a given gap therebetween. On a portion of the heating resistor 13 which is disposed between the common electrode 14 and the individual electrode 15, dot-shaped heating portions 13*a* are formed.

The common electrode 14 and the individual electrode 15 are provided with metal films having a thickness of approximately 2 $\mu$m by a sputter vapor deposition on outskirts portions of the bulging portion 12*a* of the heat insulation layer 12 at positions remote from the heating portion 13*a*. These metal films are subjected to patterning to form the lower-layer electrodes 14*a*, 15*a* by a photolithography technique.

That is, respective lower-layer electrodes 14*a*, 15*a* are formed on the outskirts portions of the bulging portion 12*a* except for the heating portion 13*a* and portions close to the heating portion 13*a*.

Further, on upper surfaces of the respective lower-layer electrodes 14*a*, 15*a*, metal films having a thickness of 0.1 to 0.3 $\mu$m are formed such that they are laminated by a sputter vapor deposition. By performing the patterning with respect to these metal films using a photolithography technique, upper-layer electrodes 14*b*, 15*b* are continuously formed from portions at positions in the vicinity of the heating portion 13*a* to upper surfaces of the lower-layer electrodes 14*a*, 15*a* excluding the heating portion 13*a*.

Then, the lower-layer electrode 14*a* and the upper-layer electrode 14*b* on the side of the common electrode 14 are electrically and mechanically connected to each other, while the lower-layer electrode 15*a* and the upper-layer electrode 15*b* on the side of the individual electrode 15 are electrically and mechanically connected to each other.

The lower-layer electrodes 14*a*, 15*a* and the upper-layer electrodes 14*b*, 15*b* are made of low fusion point metal such as aluminum, an aluminum alloy, for example.

Accordingly, in etching the lower-layer electrodes 14*a*, 15*a* and the upper-layer electrodes 14*b*, 15*b* in a given pattern by a photolithography technique, one etchant can be used.

That is, the lower-layer electrodes 14*a*, 15*a* and the upper-layer electrodes 14*b*, 15*b* according to the present invention are made of a material which can be dissolved with one etchant.

In the thermal head according to the present invention, a film thickness of the respective lower-layer electrodes 14*a*, 15*a* is made thick, that is, is set to approximately 2 $\mu$m, while a film thickness of the respective upper-layer electrodes 14*b*, 15*b* is made thin, that is, is set to 0.1–0.3 $\mu$m. Accordingly, at the time of forming the upper-layer electrodes 14*b*, 15*b* as films by sputtering, there may arise a problem of step coverage that a disconnection of the upper-layer electrodes 14*b*, 15*b* occurs at edges of the lower-layer electrodes 14*a*, 15*a*.

However, with respect to the low fusion point metal such as aluminum, by performing the sputtering such that the upper-layer electrodes 14*b*, 15*b* are laminated on the lower-layer electrodes 14*a*, 15*a*, the mutual diffusion is easily generated between the upper and lower layers and hence, the upper and lower layers can be firmly integrated.

Further, the film forming method which uses the sputtering exhibits the excellent covering ability. Accordingly, even when the temperature of the heating portion 13*a* becomes high because of the heating of the heating portion 13*a* and this high temperature is transmitted to the common electrode 14 and the individual electrode 15, there is no possibility that the lower-layer electrodes 14*a,* 15*a* and the upper-layer electrodes 14*b,* 15*b* which are integrated by sputtering are peeled off from each other or their mechanical and electric performances are deteriorated.

At the time of forming the common electrode 14 and the individual electrode 15, an external connection terminal (not shown in the drawing) which is connected to the ends of the common electrode 14 and the individual electrode 15 is simultaneously formed.

Further, on respective upper surfaces of the common electrode 14, the individual electrode 15 and the heating resistor 13, a protective layer 16 which is made of a hard ceramic such as Si—N—O or SiALON or laminated by sputtering to prevent oxidization or wear of the heating resistor 13 and the respective electrodes 14, 15 whereby the durability or the lifetime at the time of printing is enhanced.

In the protective layer 16, steps 16*a* are formed between the upper-layer power feeding layers 14*b,* 15*b* and the heating portion 13*a*. However, since the film thickness of the upper-layer electrodes 14*b,* 15*b* is extremely thin, that is, 0.1 to 0.3 $\mu$m and hence, the steps 16*a* can also be formed such that the height thereof becomes extremely small, that is, 0.1 to 0.3 $\mu$m. Due to such a constitution, there is no possibility that dregs, dusts or the like which are generated during printing are gathered at the steps 16*a*.

In the abovementioned embodiment of the thermal head according to the present invention, the case in which the lower-layer electrodes 14*a,* 15*a* and the upper-layer electrodes 14*b,* 15*b* are both made of aluminum or the aluminum alloy is explained. However, the material which constitutes at least lower-layer electrodes 14*a,* 15*a* or the upper-layer electrodes 14*b,* 15*b* can be made of any material selected from a group consisting of aluminum, copper, gold or an alloy of these metals. Since the metal material such as aluminum, copper, gold is made of low fusion point metal, sputter deposition and patterning using the photolithography technique can be easily performed.

Then, the thermal head manufacturing method according to the present invention is explained based on the flow chart shown in FIG. 2. The manufacturing method of the present invention is comprised of a first step in which the heat insulation layer 12 is formed on the heat. radiation substrate 11 by lamination, a second step in which the heating resistor 13 is formed on the heat insulation layer 12 by lamination, a third step in which the common electrode 14 and the individual electrode 15 which are connected to the heating resistor 13 are formed, and a fourth step in which a protective layer 16 which covers at least the heating resistor 13, the common electrode 14 and the individual electrode 15 is formed.

The third step includes a step in which the lower-layer electrodes 14*a,* 15*a* are formed and a step in which the upper-layer electrodes 14*b,* 15*b* are formed. In the step in which the lower-layer electrodes 14*a,* 15*a* are formed, using a material made of low fusion point metal having a favorable conductivity such as any material selected from a group consisting of aluminum, copper, gold and an alloy of these metals, a metal film having a given thickness of approximately 2 $\mu$m is formed on the heating resistor 13 by a sputter vapor deposition.

Thereafter, the metal film having a thickness of approximately 2 $\mu$m is subjected to patterning by a photolithography to respectively form the lower-layer electrode 14*a* on the side of the common electrode 14 and the lower-layer electrode 15*a* on the side of the individual electrode 15 on the heating resistor 13 at both outskirts portions of the bulging portion 12*a* formed on the heat insulation layer 12.

Subsequently, in the step in which the upper-layer electrodes 14*b,* 15*b* are formed, metal films which are made of the same material as the lower-layer electrodes 14*a*, 15*a* and have a film thickness which falls in a range of 0.1 to 0.3 $\mu$m are formed by sputtering vapor deposition from positions above the lower-layer electrodes 14*a,* 15*a* formed on the heating resistor 13 to at least positions in the vicinity of the heating portion 13*a* excluding the heating portion 13*a*.

Thereafter, using a photolithography technique, a metal film having a film thickness which falls in a range of 0.1 to 0.3 $\mu$m is subjected to patterning so as to form the upper-layer electrode 14*b* on the side of the common electrode 14 and the upper-layer electrode 15*b* on the side of the individual electrode 15 from positions in the vicinity of the heating portion 13*a* excluding the heating portion 13*a* to positions on the upper surfaces of the lower-layer electrodes 14*a,* 15*a*.

Then, after forming the upper-layer electrodes 14*b*, 15*b,* the protective layer 16 is formed in the fourth step so as to manufacture the thermal head of the present invention.

In the thermal head manufactured by the abovementioned manufacturing method, the height of the steps 16*a* which are formed in the protective layer 16 can be made extremely small, that is, 0.1 to 0.3 $\mu$m which is the same as the film thickness of the upper-layer electrodes 14*b,* 15*b*.

Further, by making the upper-layer electrodes 14*b*, 15*b* which are formed by the thermal head manufacturing method of the present invention subjected to the patterning using a photolithography technique after sputter vapor deposition, the film thickness or the width size can be formed with high accuracy so that the power loss or the irregularities of power supplied to a plurality of heating resistors 13 can be reduced.

As has been described heretofore, according to the present invention, the lower-layer electrodes of the thermal head of the present invention are formed at positions excluding the heating portion and positions in the vicinity of the heating portion and the upper-layer electrodes are continuously formed from the positions in the vicinity of the heating portion excluding the heating portion to the upper surfaces of the lower-layer electrodes and hence, even when the upper-layer electrodes and the lower-layer electrodes are dissolved using the same etchant, the upper-layer electrodes can be formed into thin films with high accuracy using the usual photolithography technique.

Accordingly, it becomes possible to make the size of the steps which are formed on the protective film extremely small so that there is no possibility that dregs and dusts which are generated during printing are gathered at the step portions and-hence, the thermal head can be realized which can perform high-quality printing without deteriorating the printing quality even when the printing is performed for a long time.

Further, the material which constitutes at least the lower-layer electrodes or the upper-layer electrodes is made of any material selected from a group consisting of aluminum, copper, gold or an alloy of these metals and hence, by forming at least the lower-layer electrodes or the upper-layer electrodes with the metal having the favorable conductivity or the alloy of these metals, the thermal head of high performance with the least power loss can be realized.

The film thickness of the upper-layer electrodes is set within a range of 0.1 to 0.3 μm and hence, the size of the steps formed in the protective layer can be made small so that there is no possibility that printing dregs or the like are gathered at the steps whereby the high-quality printing can be realized.

According to the thermal head manufacturing method of the present invention, the third step includes the step in which the metal films formed on the heating resistor are subjected to the patterning so as to form the lower-layer electrodes at portions excluding the heating portion of the heating resistor and the portion in the vicinity of the heating portion and the step in which the metal films which are continuously formed at least from the positions in the vicinity of the heating portion excluding the heating portion to the upper surfaces of the lower-layer electrodes are subjected to the patterning so as to form the upper-layer electrodes from the positions in the vicinity of the heating portion excluding the heating portion to the upper surfaces of the lower-layer electrodes and hence, the upper-layer electrodes can be formed into thin films whereby the steps formed in the protective layer can be made small.

The lower-layer electrodes and the upper-layer electrodes are formed of the same material and hence, mutual diffusion is easily generated between the upper and lower layers so that the upper and the lower layers can be integrated. Accordingly, even when the thermal head is brought into strong pressure contact with a platen at the time of printing, it becomes possible to prevent peeling-off of the lower-layer electrodes and the upper-layer electrodes from each other.

The upper-layer electrodes can be formed with high accuracy using the usual photolithography technique.

The material which constitutes at least the lower-layer electrodes or the upper-layer electrodes is made of any material selected from a group consisting of aluminum, copper, gold or an alloy of these metals. Accordingly, these metals are made of the low fusion point metal and hence, sputter vapor deposition or patterning by the photolithography technique can be performed easily so that the quality of the product can be enhanced and the manufacturing cost can be reduced.

Further, the film thickness of the upper-layer electrodes is set within a range of 0.1 to 0.3 μm and hence, the size of the steps of the protective layer can be made small. Accordingly, even when the thermal head is brought into pressure contact with the platen at the time of printing, deformation of the upper-layer electrodes can be made small so that cracks or peeling-off generated in the protective layer can be reduced whereby the thermal head of long lifetime can be manufactured by eliminating the change of the resistance value of the heating resistor.

The metal films which constitute the upper-layer electrodes are formed by the sputtering method and hence, favorable step coverage can be obtained. Accordingly, occurrences of the drawback that the upper-layer electrode is disconnected at the edge of the lower-layer electrode can be prevented whereby the thermal head can be manufactured in a stable manner.

What is claimed is:

1. A thermal head comprising a heat insulation layer which is formed on a substrate, a plurality of heating resistors which are formed on an upper surface of the heat insulation layer, a plurality of electrodes which are connected to the heating resistors and form heating portions at portions of the heating resistors, and a protective layer which covers surfaces of the heating resistors and the electrodes, wherein the electrodes are made of lower-layer electrodes and upper-layer electrodes, wherein the lower-layer electrodes and the upper-layer electrodes are made of the same material, wherein the lower-layer electrodes are formed at positions excluding the heating portions and positions in the vicinity of the heating portions, wherein the upper-layer electrodes are continuously formed from portions at positions in the vicinity of the heating portions to upper surfaces of the lower-layer electrodes excluding the heating portions, and wherein the lower-layer electrodes are made thicker than the upper-layer electrodes.

2. A thermal head according to claim 1, wherein a material which constitutes at least the lower-layer electrodes or the upper-layer electrodes is made of any material selected from a group consisting of aluminum, copper, gold and an alloy of these metals.

3. A thermal head according to claim 1, wherein a film thickness of the lower-layer electrodes is set to about 2 μm, and wherein the film thickness of the upper-layer electrodes is set to a value which falls within a range of 0.1 to 0.3 μm.

4. A thermal head manufacturing method comprising a first step in which a heat insulation layer is formed on a substrate, a second step in which a plurality of heating resistors are formed on an upper surface of the heat insulation layer, a third step in which electrodes which are connected to heating resistors are formed, and a fourth step in which a protective layer which covers at least surfaces of the heating resistors and the electrodes is formed, wherein the third step is comprised of a step in which metal films are formed on the heating resistors by patterning so as to form lower-layer electrodes on portions excluding heating portions and portions at positions in the vicinity of the heating portions of the heating resistors in a film thickness of about 2 μm and a step in which metal films made of the same material as that of the lower-layer electrodes are continuously formed by patterning from portions at positions in the vicinity of the heating portions to upper surfaces of the lower-layer electrodes excluding the heating portions so as to form upper-layer electrodes from portions at positions in the vicinity of the heating portions to upper surfaces of the lower-layer electrodes excluding the heating portions in a film thickness of 0.1 to 0.3 μm.

5. A thermal head manufacturing method according to claim 4, wherein a material which constitutes at least the lower-layer electrodes or the upper-layer electrodes is any material selected from a group consisting of aluminum, copper,-gold and an alloy of these metals.

* * * * *

UNITED STATES PATENT AND TRADEMARK OFFICE

CERTIFICATE OF CORRECTION

PATENT NO. : 6,501,497 B2
DATED : December 31, 2002
INVENTOR(S) : Takashi Shirakawa et al.

It is certified that error appears in the above-identified patent and that said Letters Patent is hereby corrected as shown below:

Column 8,
Line 7, delete "portions of" and substitute -- positions of -- in its place.
Line 61, delete "copper, -gold" and substitute -- copper, gold -- in its place.

Signed and Sealed this

Twentieth Day of May, 2003

JAMES E. ROGAN
*Director of the United States Patent and Trademark Office*